US007118177B2

(12) United States Patent
Piretti

(10) Patent No.: US 7,118,177 B2
(45) Date of Patent: Oct. 10, 2006

(54) CHAIR WITH TILTABLE BACKREST

(75) Inventor: Giancarlo Piretti, Bologna (IT)

(73) Assignee: PRO-Cord SPA, Bologna (IT)

( * ) Notice: Subject to any disclaimer, the term of this patent is extended or adjusted under 35 U.S.C. 154(b) by 0 days.

(21) Appl. No.: 11/043,005

(22) Filed: Jan. 25, 2005

(65) Prior Publication Data

US 2005/0161990 A1 Jul. 28, 2005

(30) Foreign Application Priority Data

Jan. 26, 2004 (EP) ..... 04425044

(51) Int. Cl.
*A47C 3/025* (2006.01)
*A47C 3/04* (2006.01)
*A47C 1/024* (2006.01)

(52) U.S. Cl. ..... 297/296; 297/285; 297/291; 297/292; 297/297; 297/299; 297/301.1; 297/301.4

(58) Field of Classification Search ..... 297/285, 297/289, 291, 292, 293, 296, 297, 299, 301.1, 297/301.4, 301.5, 354.1
See application file for complete search history.

(56) References Cited

U.S. PATENT DOCUMENTS 4,032,190 A * 6/1977 Muller-Deisig et al. .... 297/285
4,084,850 A * 4/1978 Ambasz ..... 297/301.4 X
4,157,203 A * 6/1979 Ambasz ..... 297/285 X
4,333,683 A * 6/1982 Ambasz ..... 297/292
4,379,589 A * 4/1983 Marino ..... 297/299
4,549,764 A * 10/1985 Haedo ..... 297/296
4,580,836 A * 4/1986 Verney ..... 297/296
4,585,272 A 4/1986 Ballarini
4,603,904 A * 8/1986 Tolleson et al. ..... 297/296
4,641,885 A * 2/1987 Brauning ..... 297/292 X
4,703,974 A * 11/1987 Brauning ..... 297/285
4,733,910 A * 3/1988 Brennan ..... 297/285
4,744,603 A * 5/1988 Knoblock ..... 297/285 X
4,776,633 A * 10/1988 Knoblock et al. ..... 297/285 X
4,790,595 A * 12/1988 Hensel et al. ..... 297/285
4,790,600 A * 12/1988 Behringer ..... 297/296 X
4,830,430 A * 5/1989 Schafer ..... 297/296 X
4,856,846 A * 8/1989 Lohmeyer ..... 297/285
4,869,552 A * 9/1989 Tolleson et al. ..... 297/296
4,981,326 A * 1/1991 Heidmann ..... 297/285 X
5,039,163 A * 8/1991 Tolleson ..... 297/297
5,100,200 A * 3/1992 Keusch et al. ..... 297/296
5,100,201 A * 3/1992 Becker et al. ..... 297/296 X (Continued)

FOREIGN PATENT DOCUMENTS

DE 3839455 A1 * 5/1990 ..... 297/285

(Continued)

OTHER PUBLICATIONS

EP Search Report, Application No. 04 42 5044, dated Jun. 24, 2004.

*Primary Examiner*—Rodney B. White
(74) *Attorney, Agent, or Firm*—Patterson & Sheridan, LLP

(57) ABSTRACT

A chair comprising a support structure bearing a seat and a backrest, in which the backrest comprises a bearing portion and a connecting portion for connection to the support structure, in which the backrest is tiltable rearwards relative to a resting position under a rearwards thrust applied by the user and elastically returns to the resting position when the rearwards thrust ceases. The rearwards tilting of the backrest is formed in part by an elastic detonation of the bearing portion and in part by a displacement of at least a part of the connecting portion relative to the support structure.

14 Claims, 9 Drawing Sheets

U.S. PATENT DOCUMENTS 5,102,196 A * 4/1992 Kaneda et al. ..... 297/285 X
5,108,149 A * 4/1992 Ambasz ..... 297/297 X
5,114,210 A * 5/1992 Naess ..... 297/285 X
5,340,197 A * 8/1994 Vogtherr ..... 297/285 X
5,452,937 A * 9/1995 Piretti ..... 297/301.4
5,580,127 A * 12/1996 Piretti ..... 297/291 X
5,649,739 A * 7/1997 Zapf ..... 297/299 X
5,662,381 A * 9/1997 Roossien et al. ..... 297/301.1
5,697,673 A * 12/1997 Favaretto ..... 297/301.1
5,704,688 A * 1/1998 Schrewe et al. ..... 297/285 X
5,887,946 A * 3/1999 Raftery ..... 297/297
5,904,397 A * 5/1999 Fismen ..... 297/291
5,957,534 A * 9/1999 Wilkerson et al. ... 297/301.1 X
5,988,746 A * 11/1999 Raftery ..... 297/297
6,533,352 B1 3/2003 Glass et al.
6,739,663 B1 * 5/2004 Gevaert ..... 297/296
2002/0117883 A1 8/2002 Gevaert

FOREIGN PATENT DOCUMENTS

DE 4316057 A1 * 11/1994 ..... 297/285
EP 552388 A1 * 7/1993 ..... 297/296
WO WO 91/03191 3/1991
WO WO 9103192 * 3/1991 ..... 297/296

* cited by examiner

CHAIR WITH TILTABLE BACKREST

CROSS-REFERENCE TO RELATED APPLICATIONS

This application claims benefit of European Patent Application serial number 04425044.7, filed Jan. 26, 2004, which is herein incorporated by reference.

BACKGROUND OF THE INVENTION

1. Field of the Invention

The present invention relates to a chair with a rearwards tiltable backrest under a rearwards thrust applied by the user.

2. Description of the Related Art

Very many types of chairs are known in which the backrest is tiltable rearwards and elastically returns to a resting position when the rearwards thrust applied by the user ceases. In most cases, the backrest is associated to a complex elastic return mechanism, provided with a high number of components.

SUMMARY OF THE INVENTION

The object of the present invention is to provide a chair with tiltable backrest which is simple, comfortable and composed by a reduced number of components that can be assembled in simple and rapid fashion.

According to the present invention, said object is achieved by a chair having the characteristics set out in claim 1.

BRIEF DESCRIPTION OF THE DRAWINGS

The features and the advantages of the chair according to the present invention shall become readily apparent from the detailed description that follows, provided purely by way of non limiting example, with reference to the accompanying drawings, in which.

DETAILED DESCRIPTION

Figure 1:
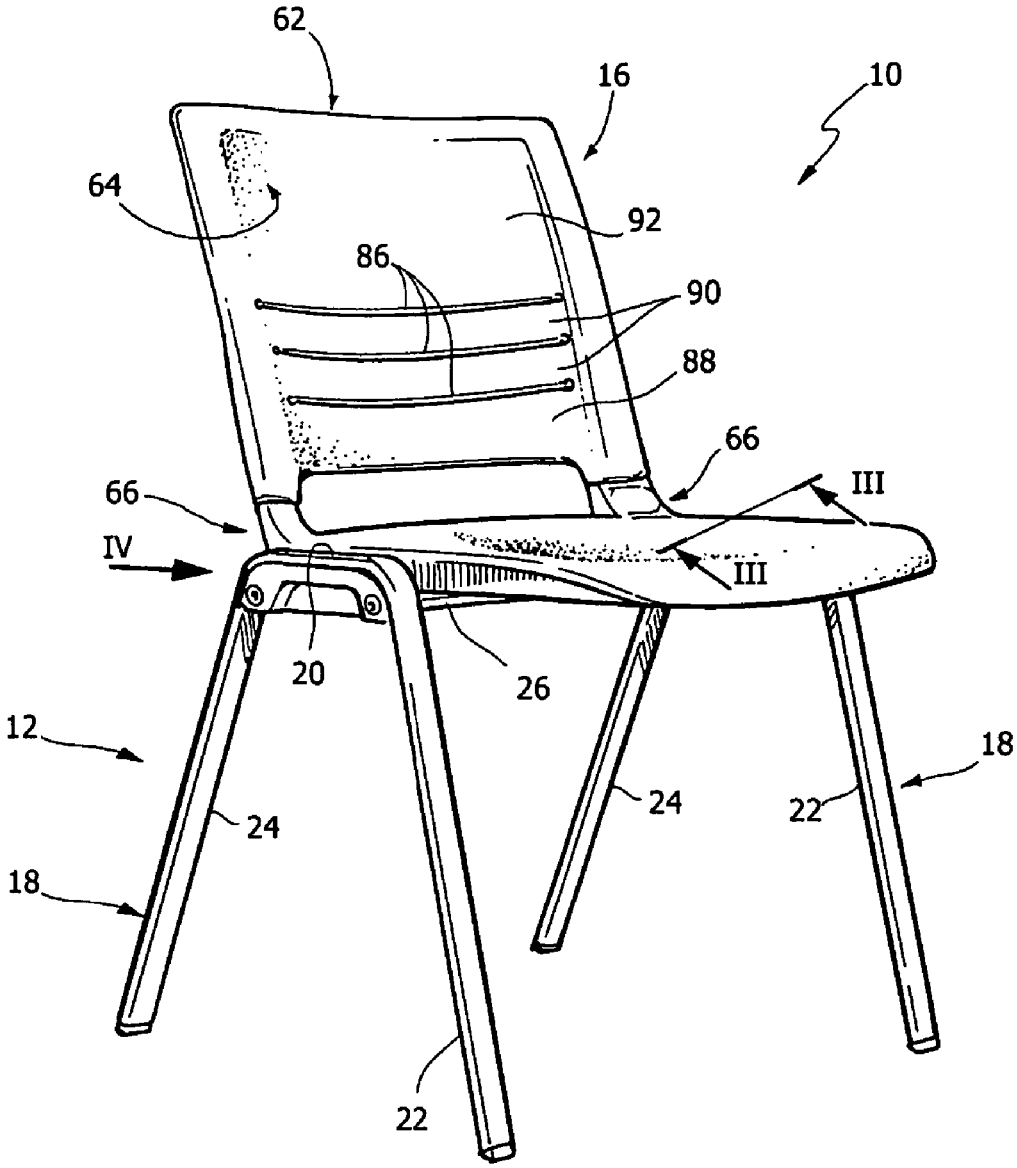
FIG. 1 is a perspective view of a first embodiment of a chair according to the present invention.

With reference to FIG. 1, the number 10 designates a perspective view of a first embodiment of a chair according to the present invention. The chair 10 comprises a support structure 12 which bears a seat 14 and a backrest 16. The support structure 12 comprises, on each side of the chair, a metallic support 18 with a substantially inverted U shape, having an upper part 20, a forward inclined branch 22 forming a front leg and a rearward inclined branch 24 forming a rear leg.

Figure 4:
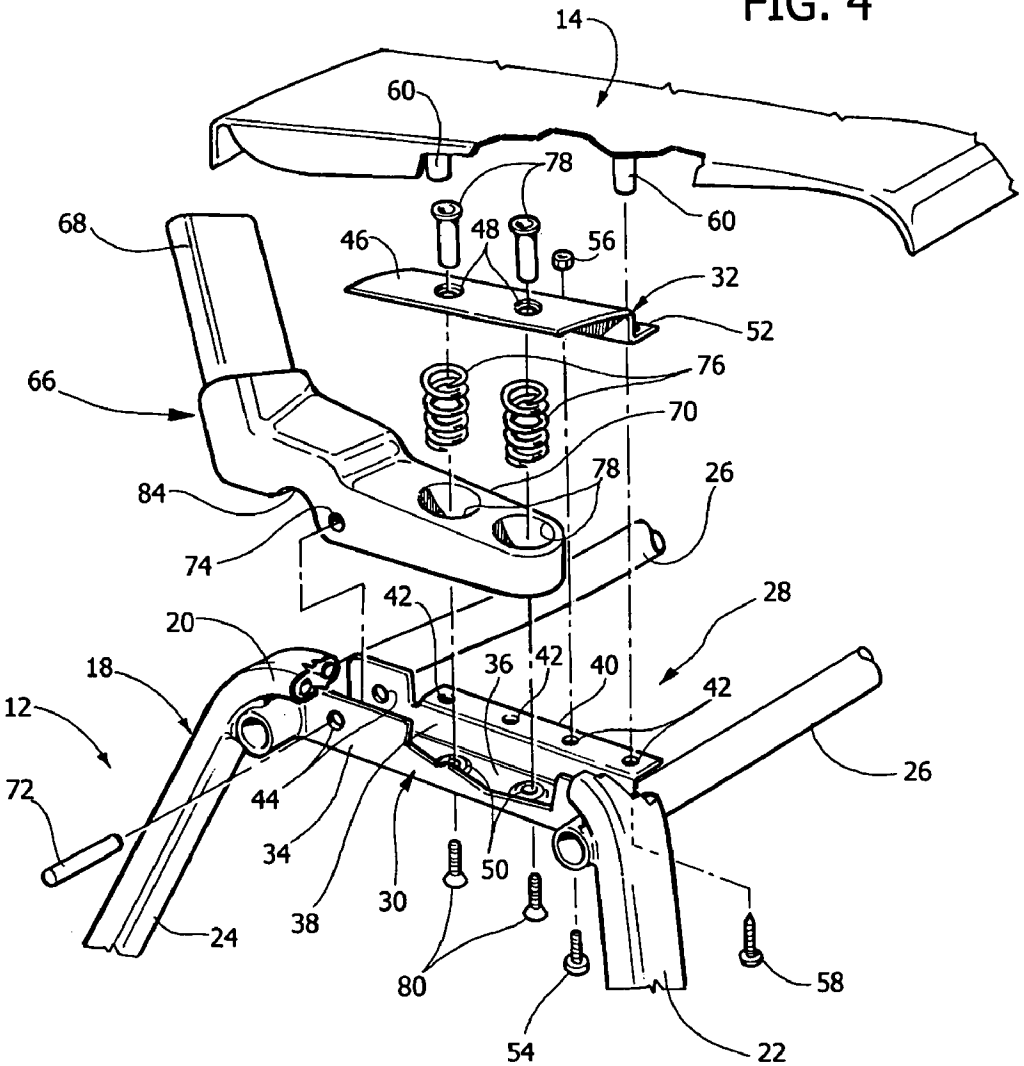
FIG. 4 is an exploded perspective view of the part designated by the arrow IV in FIG. 1.

With reference in particular to FIG. 4, the support structure 12 comprises two transverse elements 26 whose ends are fastened, for instance by welding, to the bent supports 18 forming the front legs 22 and rear legs 24 of the chair 10.

With reference to FIG. 4, the support structure 12 further comprises, on each side of the chair, a box element 28 fastened between the ends of the transverse elements 26. In the embodiment illustrated in the FIGS., the box element 28 comprises a base element 30 made of bent metal plate with a substantially channel shaped cross section, fastened to the base structure 12. For example, the base element 30 can be fastened by welding to the two transverse elements 26. The box element 28 comprises a closing element 32 fastened to the base element 30 and positioned to close the open upper side of the base element 30, in such a way as to form a closed box structure.

The base element 30 has an outer lateral wall 34, a bottom wall 36 and an inner lateral wall 38. The inner lateral wall 38 has a bent edge 40 provided with holes 42 with vertical axis. The two lateral walls 34, 38 are provided with two aligned holes 44 with horizontal axis.

The closing element 32 has a wall 36 facing the bottom wall 36 of the base element 30. The wall 46 has two holes 48 aligned to two holes 50 formed in the bottom wall 36 of the base element 30. The wall 46 has a bent edge 52 located close to the bent edge 40 of the base element 30. The closing element 32 is fastened to the base element by means of screws 54 which extend through aligned holes of the bent edges 40, 52 and which engage respective nuts 56.

The seat 14 is preferably constituted by a monolithic element made of plastic material, injection moulded and fastened to the support structure 12. In the example illustrated in FIGS. 1 through 4, the seat 14 is fastened to the bent edges 40, 52 of the two box elements 28, for instance by means of self-threading screws 58 which extend through holes of the bent edges 40, 52 and engage seats 60 integrally formed on the lower surface of the seat 14. Alternatively, the seat 14 could be fastened to a different component of the support structure 12, for instance to the transverse elements 26. As a further alternative, the seat could be movable relative to the base structure 12. For example, the seat could be oscillating relative to the base structure 12 around a transverse axis.

The backrest 16 comprises a bearing portion 62, preferably constituted by injection moulded plastic material, having a non planar bearing surface 64 against which bears the user's back. The backrest 16 comprises two connecting elements 66 which connect the bearing portion 62 of the backrest 16 to the support structure 12.

Each connecting element 66 is formed by a monolithic body, preferably constituted by metallic material, for example made of steel, aluminium or light alloy. Each connecting element 66 has a stem 68 which extends rearwards relative to the articulation pivot pin 72 and which is inserted with slight interference into a corresponding lateral seat of the bearing portion 62, so that the two connecting elements 66 are fixed relative to the bearing portion 62 of the backrest 16.

With reference in particular to FIG. 4, each connecting element 66 has a reaction portion 70 which extends forwards relative to the articulation pivot pin 72 and is housed within the corresponding box element 28. The reaction portion 70 is articulated to the base element 30 around a transverse axis by means of a pivot pin 72 which engages the holes 44 of the lateral walls 34, 38 and a hole 74 of the reaction portion 70.

Figure 3:
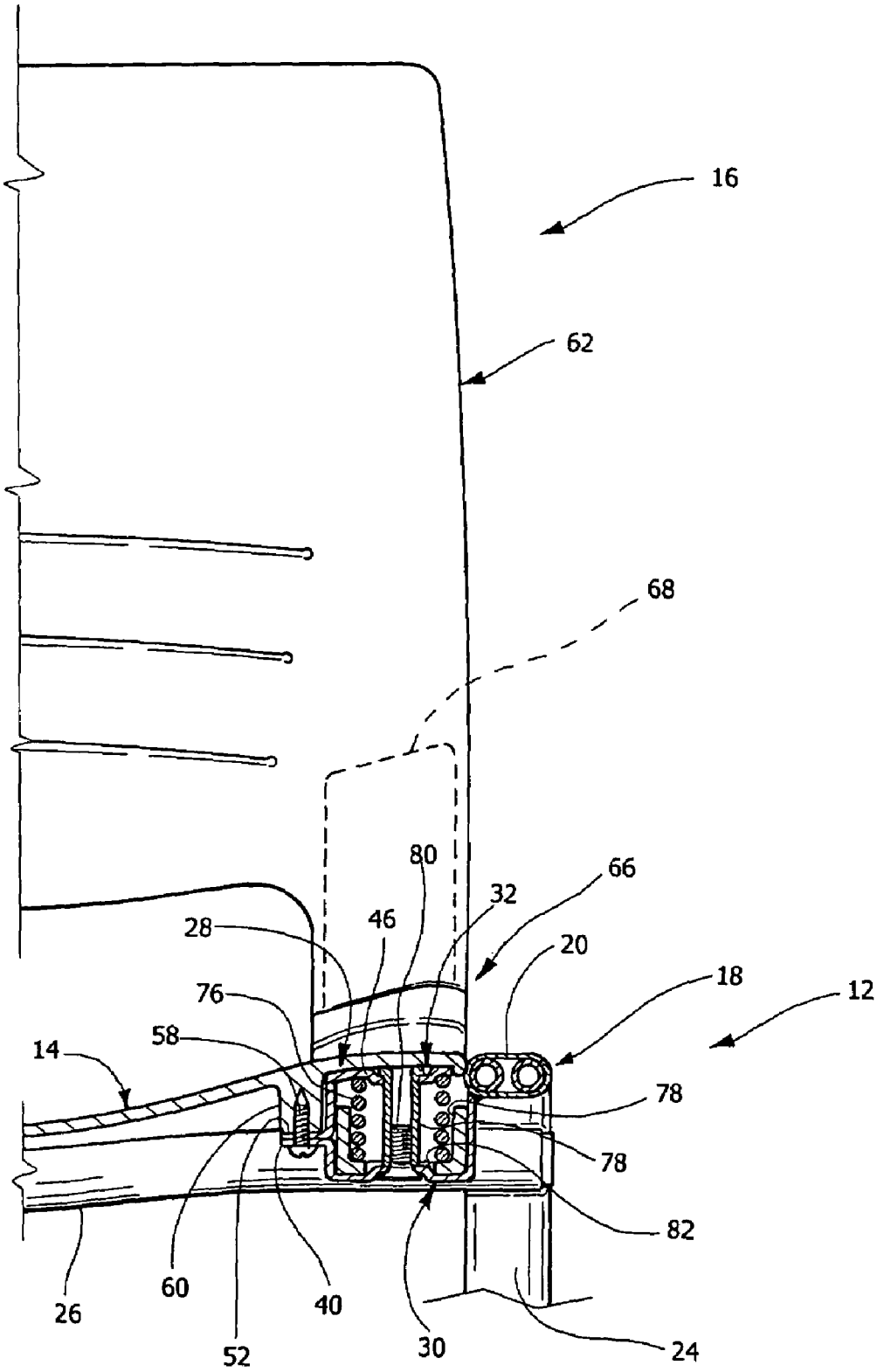
FIG. 3 is a partial section according to the line III—III of FIG. 1.

Each connecting element 66 is subject to the action of elastic means which tend to maintain the backrest 16 in a resting position and which contrast a rearwards thrust applied by the user against the bearing surface 64 of the backrest 16. In the embodiment illustrated by way of example in the figures, the elastic means are formed by two helical compression springs 76 interposed between the closing element 32 and the reaction portion 70. The springs 76 are housed within respective seats 78 of the reaction portion 70 and bear against the bottom walls of said seats. Preferably, within the springs 76 extend respective pivot pins 78 fastened between the wall 46 of the closing element 32 and the bottom wall 36 of the base element 30. The pivot pins 78 extend through the holes 48 of the wall 46 and are engaged by screws 80 which extend through the holes 50 of the bottom wall 36. As shown in FIG. 3, the pivot pins 78 extend with play through respective holes 82 formed in the bottom walls of the seats 78 of the reaction portion 70.

As shown in FIG. 4, each connecting element 66 is also provided on a lower surface thereof with a notch 84 which abuts against the rear transverse element 26 to form an end stop for the rearwards oscillation of the connecting element 66.

Figure 2:
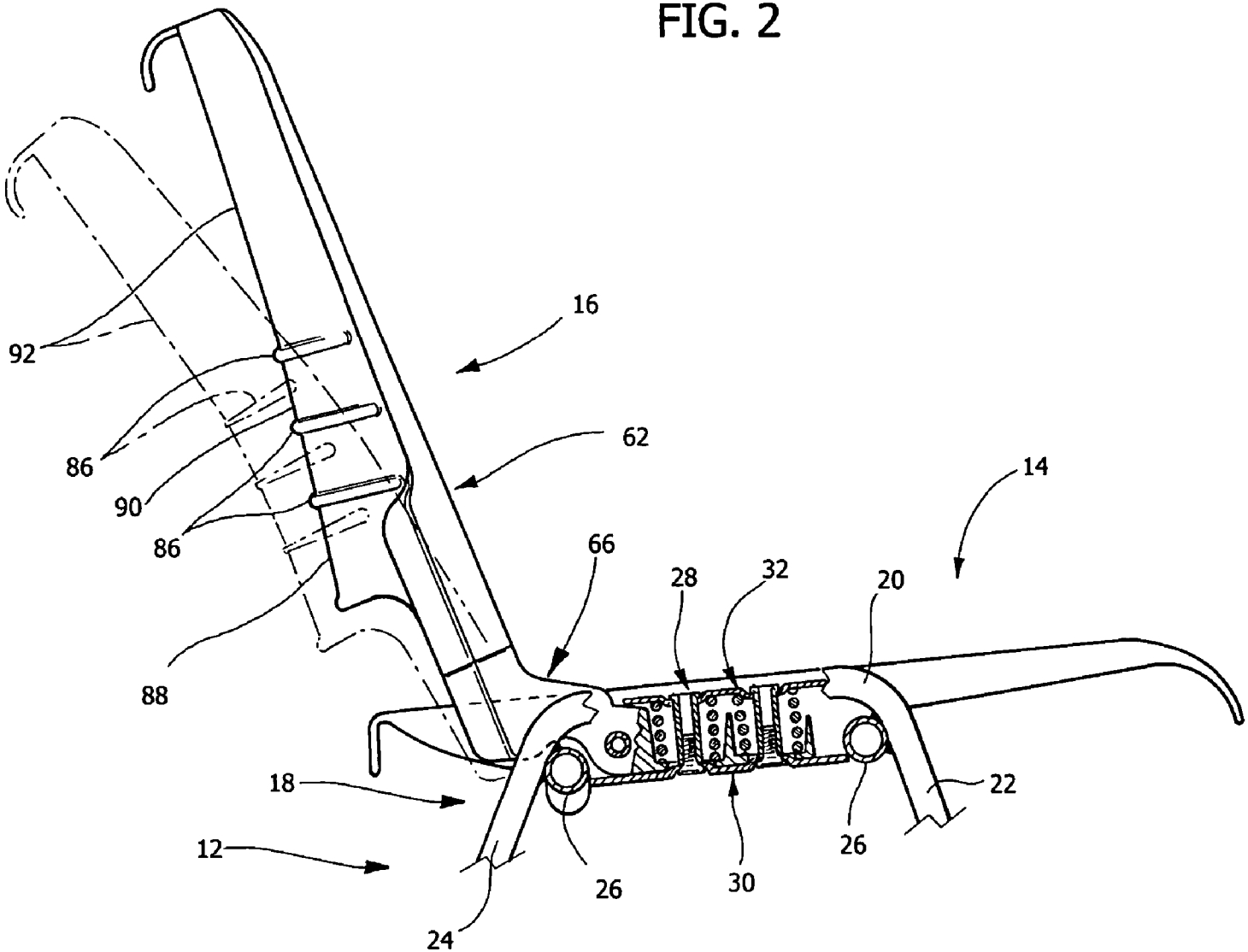
FIG. 2 is a partial lateral, and partially sectioned, view of the chair of FIG. 1.

With reference to FIGS. 1 through 3, the bearing surface 64 of the backrest 16 has an arched shape with vertical generatrices. A backrest with this shape would be substantially non deformable relative to a transverse axis. The bearing surface 64 is provided with one or more weakened area 86 whose purpose is to make elastically deformable the bearing portion 62 of the backrest 16. In the illustrated example, the weakened areas extend in the transverse direction through the bearing surface 64. However, the weakened areas could have a different orientation relative to the transverse direction.

The or each weakened area 86 can be constituted by a through notch or by a groove with reduced thickness relative to the remaining part of the bearing portion 62. In the example illustrated in the figures, the bearing portion 62 of the backrest 16 is provided with three mutually parallel weakened areas 86, each of which is shaped as a transverse line which extends substantially over the whole width of the bearing surface 64 with the exception of the lateral edges of the backrest 16. The number of the weakened areas 86 may naturally vary according to the applications.

The three weakened areas 86 subdivide the bearing portion 62 of the backrest 16 into four sections: a lower section 88, two intermediate sections 90 and an upper section 92. Each weakened area 86 forms a hinge which allows a relative inclination between adjacent backrest sections. Each weakened area allows an elastic deformation of the bearing portion 62 under the action of a rearward thrust applied by the user, so that the bearing portion 62 as a whole can be deformed as shown with dashed and dotted line in FIG. 2 relative to the non deformed configuration illustrated in the same figure with continuous line. When the rearwards thrust on the bearing portion 62 cease, the backrest sections 88, 90, 92 go back to their non deformed configuration thanks to the elastic return of the material.

Each weakened area 86 is intrinsically provided with an arrest which limits the maximum angle of relative inclination between the adjacent backrest sections. As shown in FIG. 2, the maximum angle of relative inclination between two adjacent backrest sections is defined by the condition in which the rear edges of each weakened area 86 come in contact with each other. The height of each weakened area 86 therefore defines the maximum angle of rearwards inclination between the adjacent backrest sections.

In use, the backrest 16 is capable of tilting rearwards under the action of a thrust applied by the user. A part of the rearwards inclination of the backrest 16 is due to an oscillating motion of the connecting elements 66 relative to the support structure 12 around the axes of the pivot pins 72. Another part of the rearwards tilting motion of the backrest 16 is due to the deformation of the bearing portion 62 of the backrest 16. The oscillating motion of the bearing elements 66 is contrasted by the action of the springs 76 whilst the deformation of the bearing portion 62 is contrasted by the elasticity of the material. In a practical embodiment, the two components of the tilting motion of the backrest 16 have substantially the same amplitude, for instance the rearwards inclination of the bearing elements 66 allows an inclination of the backrest by about 9° and the deformation due to the relative inclination of the backrest sections 88, 90, 92 allows an additional inclination of about 9°. The combination of these two motions (inclination of the backrest 16 and deformation of the bearing portion 62 of the backrest 16) allows to obtain ideal conditions of comfort for the user.

FIGS. 5 through 10 show a second embodiment of a chair according to the present invention. The details corresponding to those described above are designated by the same numeric references.

In this variant of the invention, the connecting elements 66 of the backrest 16 are integrally formed with the remaining part of the backrest 16 and are fastened to the support structure 12 instead of being oscillating relative to the support structure as in the previously described variation. The connecting elements 66 are elastically yielding and allow an inclination of the backrest by effect of an elastic deformation of a part thereof.

Figure 10:
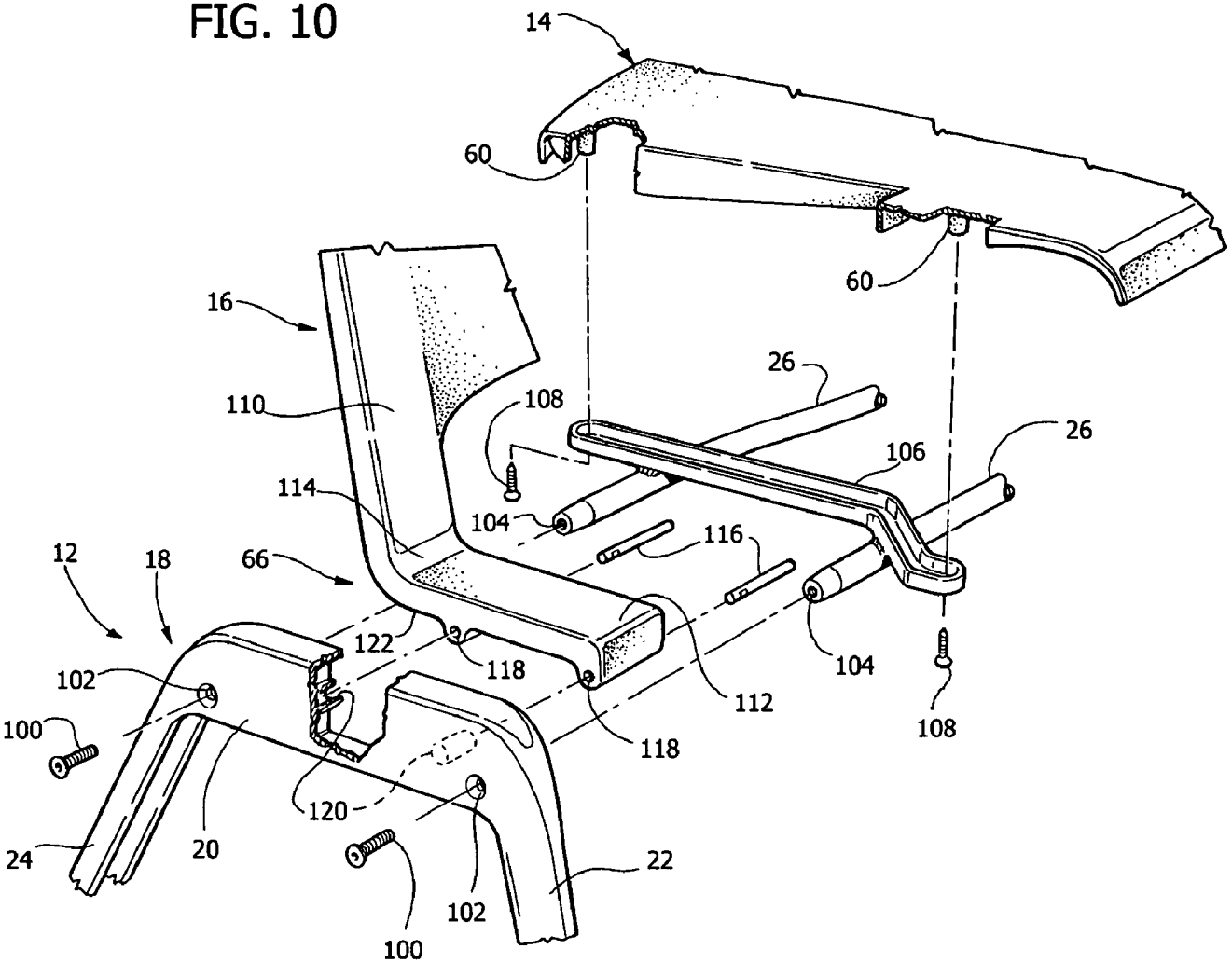
FIG. 10 is an exploded perspective view of the part designated by the arrow X in FIG. 5.

With reference in particular to FIG. 10, the support structure 12 of the chair comprises two transverse elements 26 which are fastened at each of their ends to the upper part 20 of the corresponding support 18. In the illustrated example, transverse elements 26 are fastened to the supports 18 by means of horizontal screws 100 which extend through holes 102 of the upper part 20 of each support 18 and engage threaded holes 104 formed at the ends of the transverse elements 26.

With reference again to FIG. 10, the support structure 12 comprises, on each side of the chair, a support element 106 fastened, for instance by means of welding, to the transverse elements 26. The seat 14 is fastened to the support elements 106 by means of screws 108.

The backrest 16, has at the two sides of the bearing surface 64, two relatively rigid 110 uprights preferably obtained in monolithic form with the remaining part of the bearing surface 64 by moulding of plastic material. Each upright 110 has a lower integral portion bent forwards in substantially L shape, forming a connecting element 66 for connecting the backrest 16 to the support structure 12.

With reference in particular to FIG. 10, each connecting element 66 has a horizontal fastening portion 112 which is joined to a corresponding upright 110 by an elastically yielding area 114. The horizontal fastening portion 112 of each connecting element 66 is fastened to the upper part 20 of the corresponding support 18. Preferably, said fastening is obtained by means of a pair of horizontal pivot pins 116 each of which engages a hole 118 of the horizontal fastening portion 112 and a hole 120 of the upper part 20 of the support 18 (see also FIG. 9).

Figure 6:
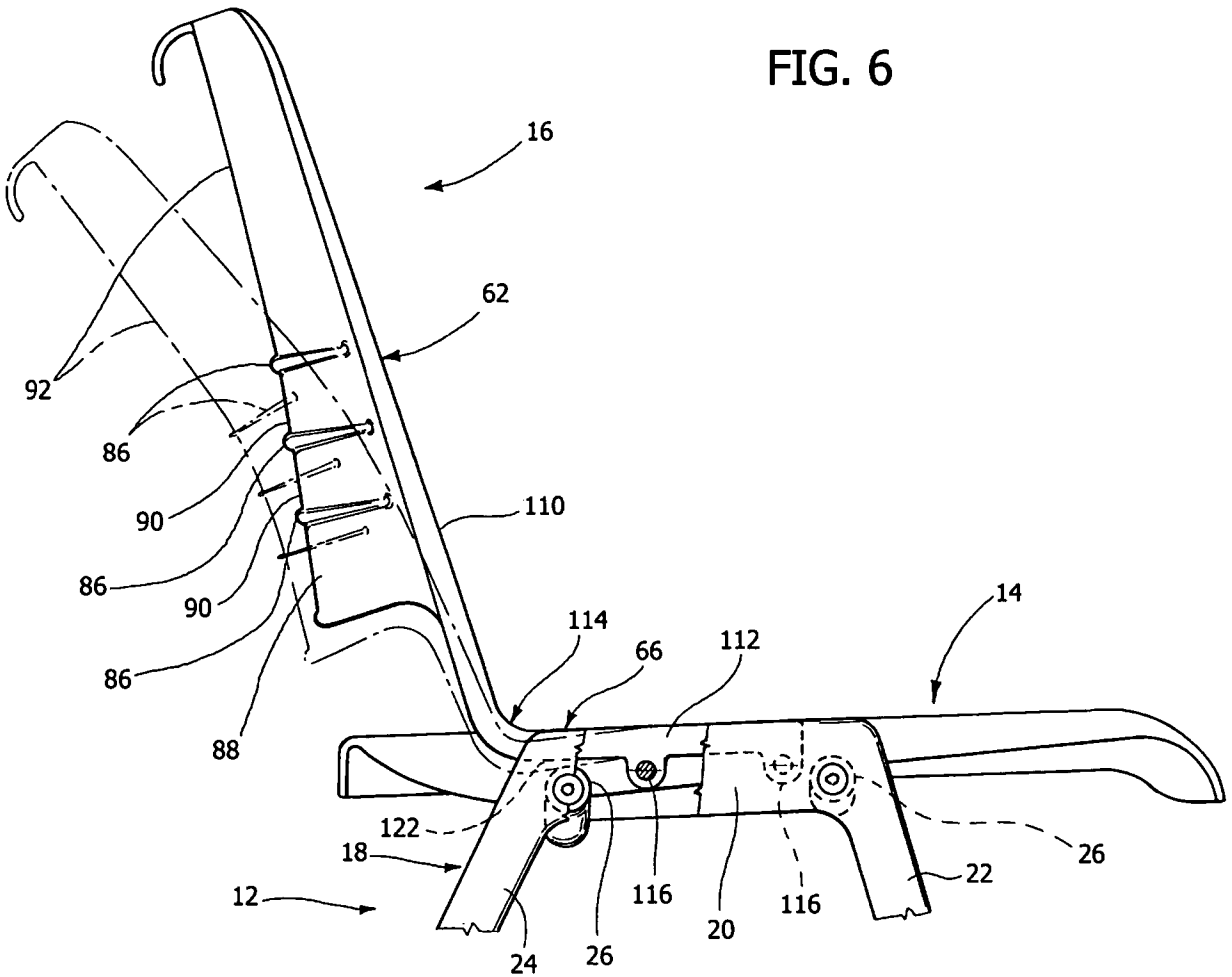
FIG. 6 is a partial lateral view of the chair of FIG. 5.
Figure 7:
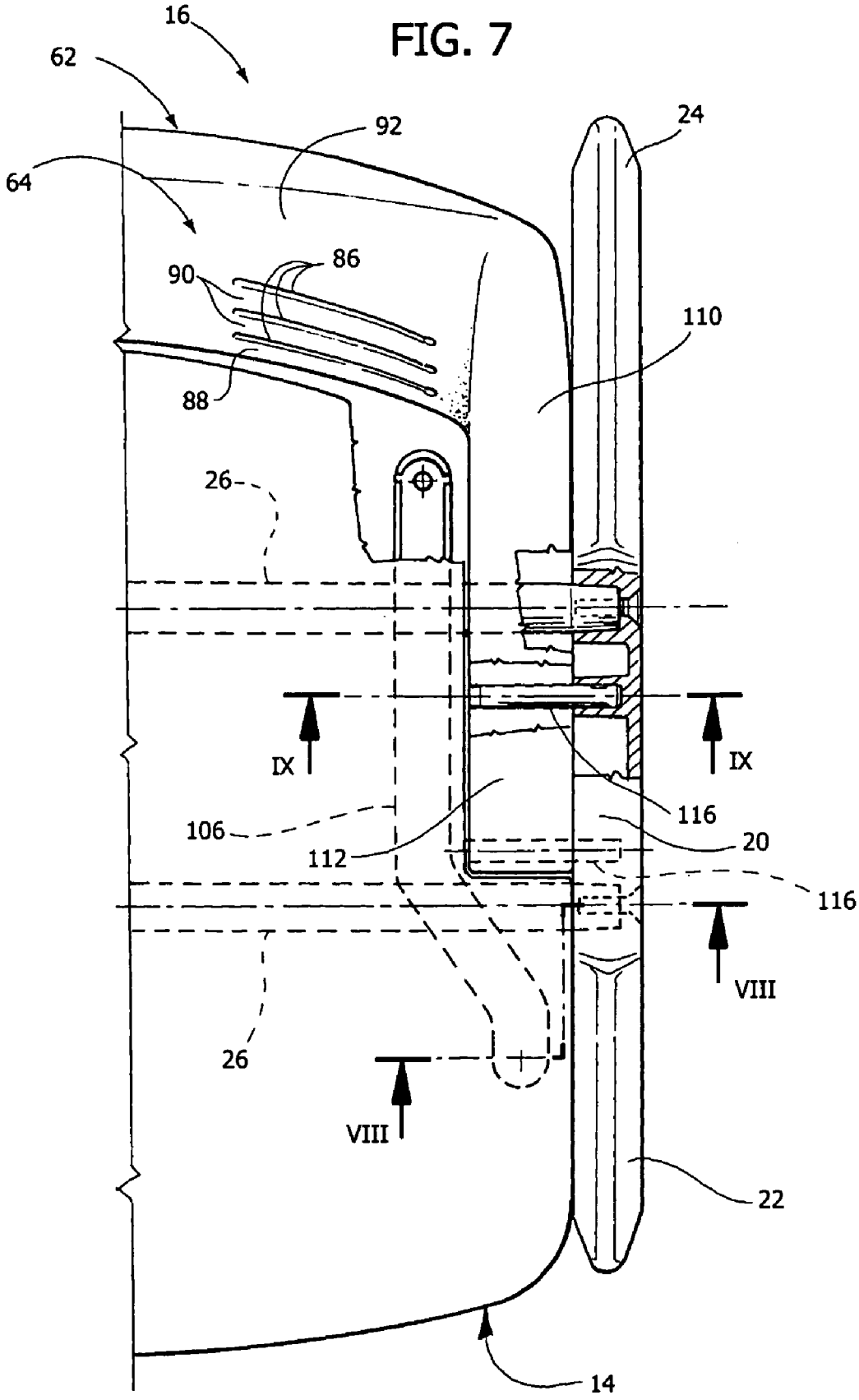
FIG. 7 is a partial plan view, partially sectioned according to the arrow VII of FIG. 5, FIGS. 8 and 9 are partial sections according to the lines VIII—VIII and IX—IX of FIG. 7.
Figure 8:
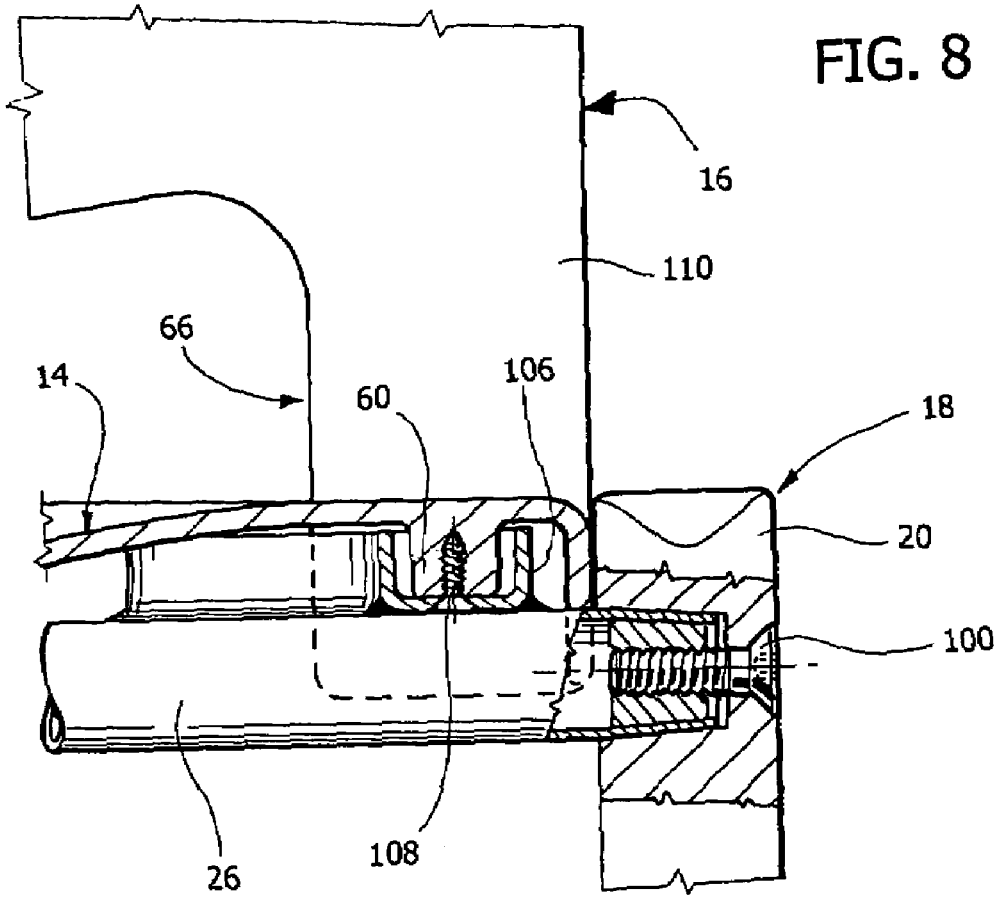
Figure 9:
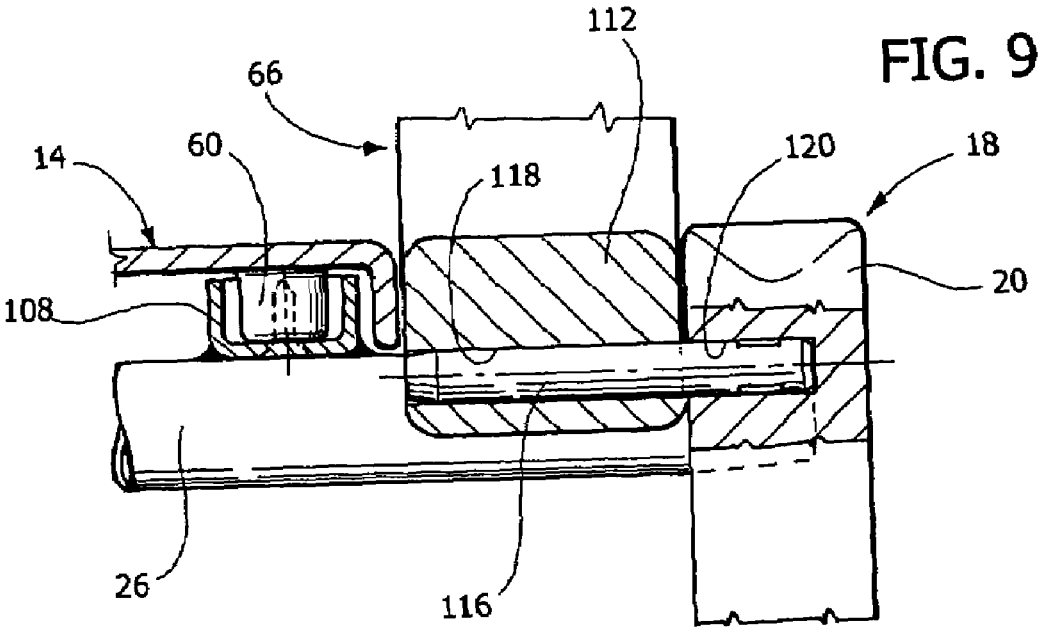

As shown in FIG. 6, the elastically yielding junction portion 114 of each connecting element 66 allows a rearwards inclination of the respective upright 110 under the action of a rearwards thrust applied by the user on the backrest 16. The elastically deformable portion 114 has a lower surface 122 which is destined to come in arresting contact against the rear transverse element 26 to limit the rearwards inclination travel of the backrest 16.

Figure 5:
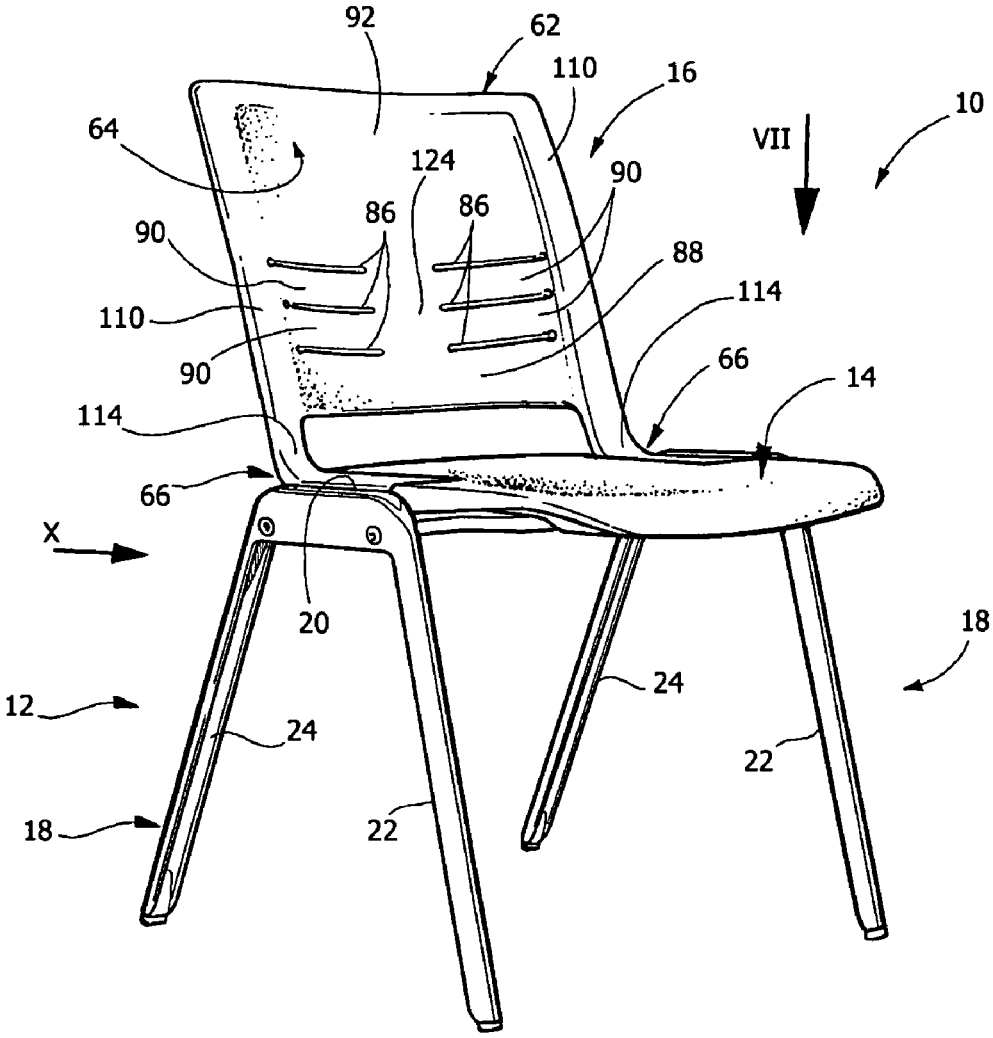
FIG. 5 is a perspective view of a second embodiment of a chair according to the present invention.

As in the previously described embodiment, the bearing portion 62 of the backrest 16 is provided with weakened areas 86 which allow an elastic deformation of the bearing surface 64 as shown with dashed and dotted line in FIG. 6. As shown in FIG. 5, in this second embodiment the weakened areas 86 are formed by a plurality of transverse lines interrupted at the central part of the backrest, to leave a central area 124 of the bearing surface 64 that is not traversed by the weakened areas 86. The manner whereby the bearing portion 62 of the backrest 16 is deformed under the rearwards thrust applied by the user is identical to the one described previously. The presence of the central area 124 lacking weakened areas makes the bearing portion 62 stiffer.

From FIGS. 1 and 5 it is readily apparent that the structure of the chair 10 allows the vertical superposition of multiple chairs of the same type. The means which allow the rearwards inclination of the backrest 16 have very limited bulk in the vertical direction and do not limit the vertical superposition of the chairs in any way.

While the foregoing is directed to embodiments of the present invention, other and further embodiments of the invention may be devised without departing from the basic scope thereof, and the scope thereof is determined by the claims that follow.

The invention claimed is:

1. A chair comprising:

a support structure for supporting a seat and a backrest, in which the backrest comprises a bearing portion and two connecting portions for connecting the backrest to the support structure, wherein the bearing portion is a surface for bearing a user's back and is provided with at least one weakened area which allows a relative elastic deformation between two adjacent backrest sections, characterized in that said weakened area has the shape of a line which extends on the surface of the backrest, wherein the two connecting portions each comprise a reaction portion housed within a box element that is fixed relative to the support structure and each of the box elements contain an elastic element, and the backrest is tiltable rearwards relative to a resting position under a rearwards thrust applied by the user and elastically returns to the resting position when said rearwards thrust ceases, characterized in that the rearwards tilting of the backrest is formed in part by an elastic deformation of the bearing portion and in part by a displacement of at least a part of the connecting portion relative to the support structure.

2. A chair as claimed in claim 1, characterized in that said weakened area further comprises at least one through slot.

3. A chair as claimed in claim 1, characterize in that said weakened area further comprises at least one slot with reduced thickness.

4. A chair as claimed in claim 1, characterized in that said weakened area substantially extends over the whole length of the bearing surface of the backrest.

5. A chair as claimed in claim 1, characterized in that the bearing surface of the backrest has a central area which is not traversed by said weakened area.

6. A chair as claimed in claim 1, characterized in that it comprises a plurality of mutually parallel weakened areas.

7. A chair as claimed in claim 1, characterized in that the bearing portion of the backrest has a bearing surface with an arched shape with vertical generatrices.

8. A chair as claimed in claim 1, wherein the two connecting portions are mounted oscillating relative to the support structure and co-operating with the elastic element tending to thrust the backrest towards the resting position.

9. A chair as claimed in claim 1, characterized in that said connecting portion comprises two connecting elements each of which has a fastening portion that is fixed relative to the support structure, each of said connecting elements having an elastically yielding portion.

10. A chair comprising:

two support structures each comprising two legs and a substantially horizontal portion;

a seat connectable to each support structure;

a backrest, wherein the backrest comprises two connector portions and a bearing portion wherein the bearing portion is a surface for bearing a user's back, the bearing portion having one or more through slots for allowing the backrest to incline relative to itself, the one or more slots comprising an arrest for limiting the maximum inclination of the backrest adjacent the slots, the arrest comprising the rear edges of each side of the one or more slots;

a connecting element attachable to each support structure for attaching the two support structures to the two connector portions, the connecting element housed within a box element that is fixed relative to the support structure; and an elastic element between the connecting element and the support structure for allowing the connecting element to move relative to the support structure.

11. The chair of claim 10, wherein the elastic element further comprises two or more coiled springs.

12. The chair of claim 10, wherein the support structures are substantially on two opposing edges of the seat.

13. The chair of claim 1, wherein the box element comprises a substantially channel shaped cross section and a closing element for closing the open side of the channel.

14. The chair of claim 10, wherein the box element comprises a substantially channel shaped cross section and a closing element for closing the open side of the channel.

* * * * *